US005375701A

United States Patent [19]

Hustad et al.

[11] Patent Number: 5,375,701

[45] Date of Patent: Dec. 27, 1994

[54] FOOD PACKAGE HAVING A COMPARTMENTALIZED RIGID BASE TRAY

[75] Inventors: Gerald O. Hustad, McFarland; Yolanda M. Launder, Middleton; Bjorn J. Thompson; Joel W. Johnson, both of Madison, all of Wis.

[73] Assignee: Oscar Mayer Foods Corporation, Madison, Wis.

[21] Appl. No.: 966,613

[22] Filed: Oct. 19, 1992

Related U.S. Application Data

[63] Continuation of Ser. No. 609,533, Nov. 6, 1990, abandoned.

[51] Int. Cl.[5] ..... B65D 73/00

[52] U.S. Cl. ..... 206/45.18; 206/45.24; 206/461; 206/545; 229/3.5 R

[58] Field of Search ..... 206/45.18, 45.24, 45.25, 206/461, 467, 469, 545, 564; 220/628, 636; 229/3.5 R

[56] References Cited

U.S. PATENT DOCUMENTS

| | | | |
|---|---|---|---|
| D. 224,585 | 8/1972 | Jewell . | |
| D. 244,586 | 8/1972 | Jewell . | |
| D. 265,551 | 7/1982 | Colby et al. . | |
| D. 282,821 | 3/1986 | Noyes . | |
| D. 305,204 | 12/1989 | Reifein et al. . | |
| D. 305,205 | 12/1989 | Grindrod et al. . | |
| 2,950,040 | 8/1960 | Bolding | 40/312 |
| 2,965,501 | 12/1960 | Harriss . | |
| 3,037,677 | 6/1962 | Deb | 206/459 |
| 3,115,245 | 12/1963 | Schechter | 229/902 |
| 3,292,810 | 12/1966 | Schechter . | |
| 3,373,045 | 3/1968 | Peterson . | |
| 3,401,863 | 9/1968 | Wall . | |
| 3,443,681 | 5/1969 | Wysocki . | |
| 3,451,612 | 6/1969 | Sinoto . | |
| 3,487,915 | 1/1970 | Scott . | |
| 3,586,235 | 6/1971 | Nathan . | |
| 3,651,928 | 3/1972 | Weisman . | |
| 3,785,546 | 1/1974 | Kuster | 206/45.24 |
| 3,796,366 | 3/1974 | Hahn | 229/3.5 R |
| 3,903,309 | 9/1975 | Mahaffy et al. . | |
| 3,933,296 | 1/1976 | Ruskin et al. . | |
| 4,146,128 | 3/1979 | Hogg et al. . | |

(List continued on next page.)

FOREIGN PATENT DOCUMENTS

| | | | |
|---|---|---|---|
| 0273840 | 7/1988 | European Pat. Off. . | |
| 0441666 | 8/1991 | European Pat. Off. . | |
| 2553215 | 4/1985 | France | 206/459 |
| 3110847 | 9/1982 | Germany . | |

OTHER PUBLICATIONS

Cover page "Neue Verpackung" magazine, Mar. 1986.

Cover page "Neue Verpackung" magazine, Jul, 1987 (see the package labelled Salzsticks on the right hand side).

Crystal Tube Corp.; "Smart Cookies" ad in *Moder Packaging;* p. 146, Jan. 1953.

Oscar Mayer Foods Corp.; "Breakfast for One" around May, 1986.

(List continued on next page.)

*Primary Examiner*—David T. Fidei

*Attorney, Agent, or Firm*—Joseph T. Harcarik

[57] ABSTRACT

A food package comprising a rigid plastic base tray having at least three compartments, the tray being covered by a flexible film which is airtightly sealed to flanges of the tray to airtightly or hermetically seal the respective compartments. A label structure integrally associated with the flexible film has opaque areas for label information and transparent areas for viewing the product. The label structure may be formed by separate pressure sensitive labels, by printing on the flexible film itself or by a shrink wrapped band with printing thereon. A structure associated with the bottom of the tray may provide rigidity, protect the bottom of the tray, provide an additional area for commercial information and/or provide a stand-up feature. The materials of the package may be selected to maximize recyclability.

30 Claims, 9 Drawing Sheets

U.S. PATENT DOCUMENTS

| | | | |
|---|---|---|---|
| 4,233,367 | 11/1980 | Ticknor et al. . | |
| 4,240,522 | 12/1980 | Brown | 206/459 |
| 4,346,833 | 8/1982 | Bernhardt | 206/459 |
| 4,355,721 | 10/1982 | Knott, II et al. | 229/3.5 R |
| 4,355,755 | 10/1982 | Faller . | |
| 4,382,513 | 5/1983 | Schirmer et al. | 206/484 |
| 4,405,667 | 9/1983 | Christensen et al. | 206/484 |
| 4,444,827 | 4/1984 | Swaroop | 229/3.5 R |
| 4,537,305 | 8/1985 | Takanashi | 206/484 |
| 4,570,818 | 2/1986 | Borst et al. . | |
| 4,669,611 | 6/1987 | Flaherty . | |
| 4,701,360 | 10/1987 | Gibbons et al. | 229/3.5 R |
| 4,944,603 | 7/1990 | Cornish et al. . | |
| 4,961,494 | 10/1990 | Alexander | 206/45.24 |
| 5,011,006 | 4/1991 | Anderson | 206/45.18 |
| 5,119,940 | 6/1992 | Grindrod | 206/564 |

OTHER PUBLICATIONS

Oscar May Foods Corp.; "Lunch Packs" around 1988.

Oscar Mayer Foods Corp.; "Breakfast Packs" around Oct. 1987.

Oscar Mayer Foods Corp.; "Deluxe Meat Salads" around 1988.

FIG. 30
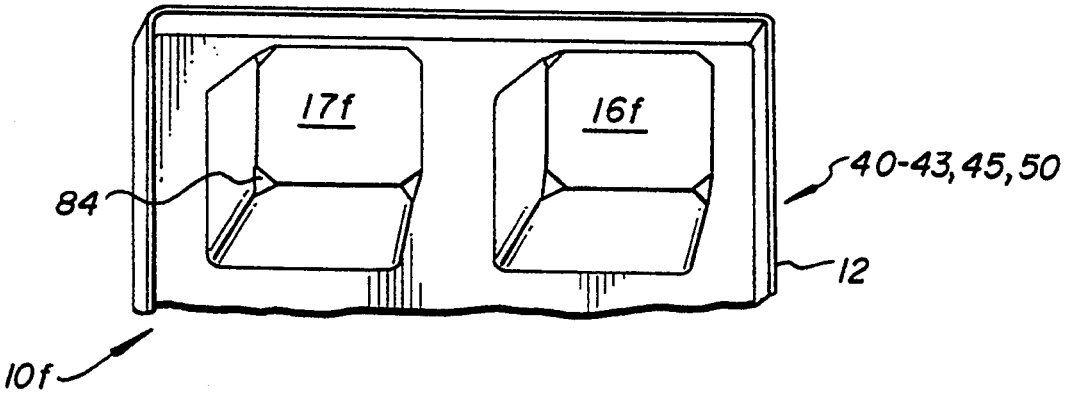
FIG. 31
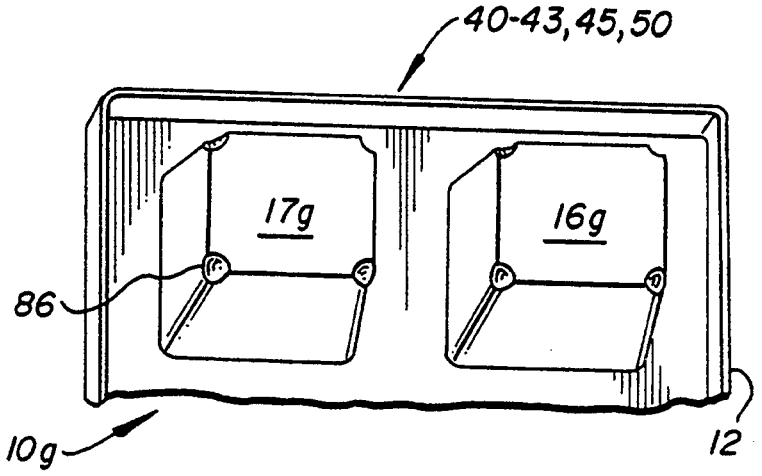
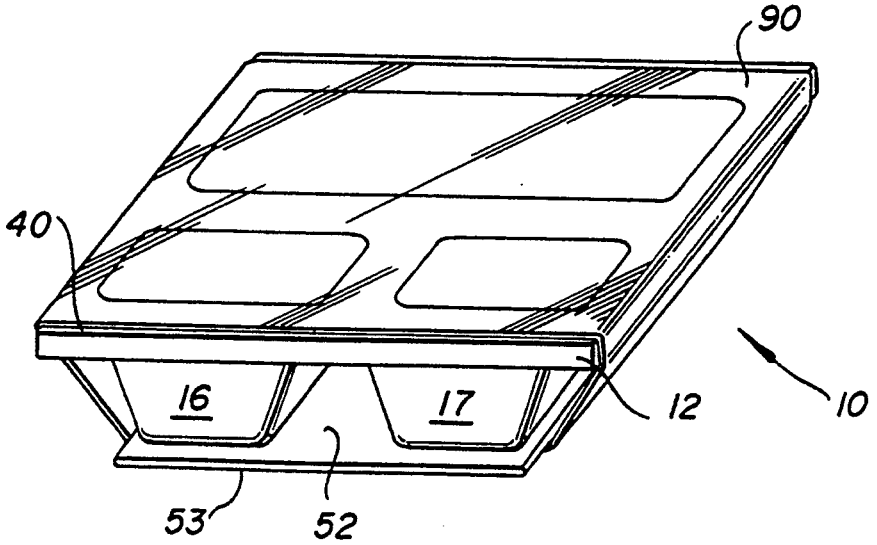
FIG. 32

FIG. 33
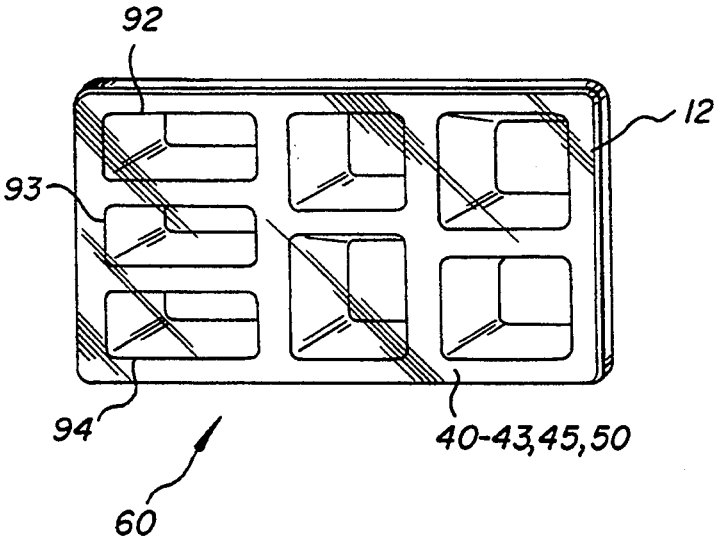
FIG. 34
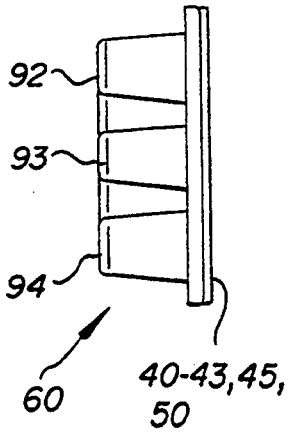
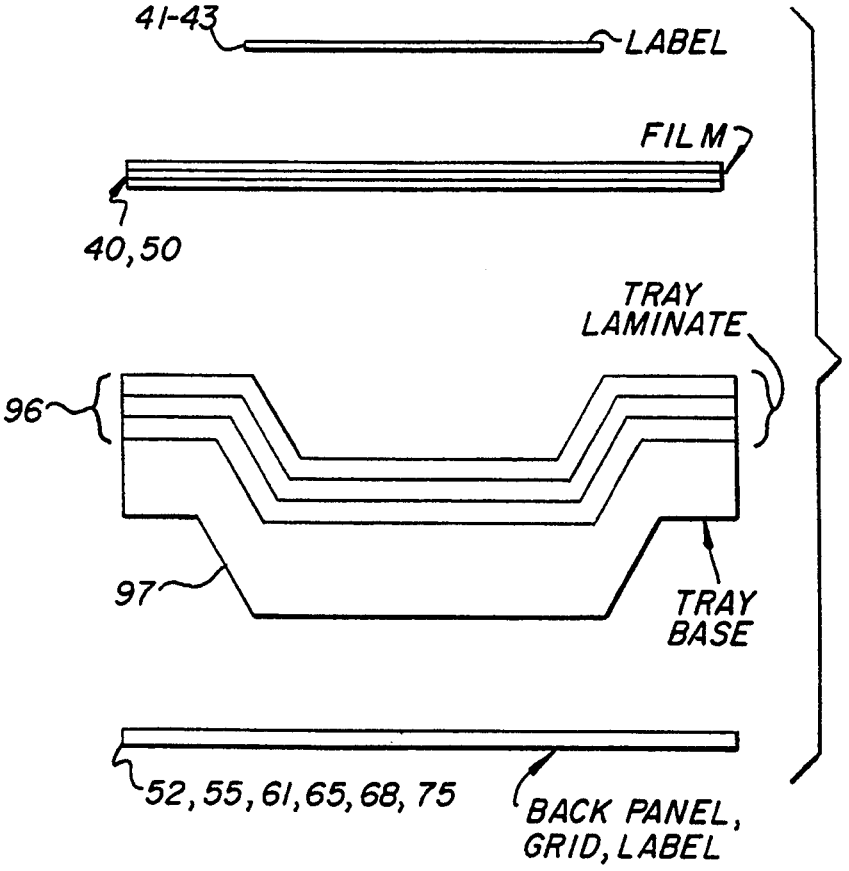
FIG. 35

FOOD PACKAGE HAVING A COMPARTMENTALIZED RIGID BASE TRAY

This application is a continuation of application Ser. No. 07/609,533 filed Nov. 6, 1990, now abandoned.

FIELD OF THE INVENTION

This application relates to packages, and in particular it relates to a food package having a compartmentalized rigid base tray and a flexible film hermetically sealing the compartments.

BACKGROUND OF THE INVENTION

Various food packages are known which contain food in a form which is visible to the purchasing consumer. One such package comprises a rigid base tray having food receiving compartments therein and covered with a transparent flexible film which hermetically seals the compartments. When the package is to travel in ordinary channels of commerce between the original manufacturer and the supermarket shelf, there is a need to provide, in addition to the basic food containing and sealing function of the container, a means to convey label information to the consumer, to provide a mechanism which allows the package to stand on edge or otherwise be displayed in an upright position and/or to preserve the structural integrity of the package.

Heretofore, in a package of the present type, these functions have been provided by an outer closure container such as that shown in U.S. Pat. Des. Nos. 305,204 and 305,205. However, since outer enclosures use a large amount of material, they tend to be relatively expensive. Also, for environmental purposes, it is desirable to minimize the quantity of packaging material required for any given food product and/or to use materials which facilitate recycling and are therefore "environmental friendly". Additionally, consumers often favor packages using less packaging material because they enhance visibility of the product.

Thus, there exists a need to provide, in a food package of the present type, new and improved means to convey label information, to provide a mechanism for the package to stand on edge or otherwise be disposed in an upright position and/or to preserve the structural integrity of the package during travel in ordinary channels of commerce while reducing the quantity of the packaging material itself and maintaining a high level of consumer impact.

SUMMARY OF THE INVENTION

According to the present invention, a food package is provided which comprises a compartmentalized rigid base tray which holds the food products and is covered by a flexible film which hermetically seals the compartments. In combination therewith, labelling means are provided which eliminate the need for an outer enclosure container, while still providing sufficient space to convey label information. Additionally, means are provided for displaying the package in an upright position and/or preserve the structural integrity of the package in a way which maintains a high level of consumer impact.

The rigid base tray, which is preferably formed from a single sheet of material, has recessed compartments for holding the food product and a generally taut flexible film which extends across the top of the base tray. Peripheral and internal flanges of the base tray, which form upper portions of the tray, are located in a common reference plane, against which reference plane the flexible film is applied.

The rigid base tray forms compartments having side walls and having a height of at least 0.35 inches. The flexible film is affixed to the peripheral and internal flanges of the rigid base tray to form an airtight container. The term "taut condition" refers to the interaction between the rigid base tray and the flexible film, whereby the film is drawn from its attachments to the peripheral and internal flanges of the rigid base tray generally straight across the top of the tray, thereby enhancing visualization of the food contents within the compartments of the rigid base tray. Preferably, the flexible film has a surface area on the top of the tray of at least 10 square inches. Preferably, the product is subjected to a vacuum, after which an inert gas is flushed into the container to provide the environment for the food contained therein.

A package of this type allows for easy packaging of the food products and employs standard packaging material and standard packaging methods.

In one preferred arrangement, a tray of this type is generally square in plan view and has a large compartment which takes up approximately half of the area of the tray and is bordered on one side by a long internal flange and a pair of smaller generally square compartments positioned side-by-side, on the opposite side of the large internal flange. The two smaller compartments are separated by a smaller internal flange. In another preferred arrangement, the tray is rectangular with three rows of compartments, each row extending for the full width of the rectangle, the middle row being separated from the other two rows by internal flanges which run the entire width of the tray. Each of the rows may have any desired number of compartments, for example one, two or three. In addition to these preferred arrangements, the tray may be of virtually any desired size or shape and can have any selected arrangement of compartments.

In combination therewith, the present invention provides various labelling arrangements, various means for permitting the package to be displayed in an upright position and various means for protecting the structural integrity of the package. All of these improvements have in common that they are achieved with significantly less packaging material than the previously used outer container, thereby minimizing costs and providing a package which is more environmentally desirable. In addition, the present invention preferably provides these improvements utilizing materials capable of being recycled and thereby further improving the environmental desirability of the package.

A first labelling arrangement comprises the use of one or more generally flat labels which are adhered to a transparent flexible film, preferably covering at least 30% but preferably approximately at least 50% of the top of the tray. Such a label or labels would be positioned so as to maximize the area for conveying label information while concurrently leaving a sufficient portion of the film unobstructed so as to permit the consumer to directly view the food content within the respective compartments. Preferably, the label or labels would be of such a thickness and cover such an area that some protection against inadvertent damage to the flexible film would be provided. Also, preferably the label or labels will preferably be located against the peripheral and internal flanges of the rigid base tray so that these portions of the rigid base tray will provide a backing surface to facilitate application of the label or labels to the flexible film.

According to a second labelling arrangement of the present invention, the label may take the form of a full faced label extending over the entire top surface of the transparent flexible film and the rigid base tray, within the entire area defined by the peripheral flanges. In this arrangement, visualization of the product would be provided through cut-outs formed in this label, as contrasted to the first described arrangement wherein visualization would be provided between and around the relatively smaller label or labels. Such a full faced label has the additional advantage that it may essentially duplicate the appearance of the top of the existing outer enclosure container as shown in U.S. Pat. Des. No. 305,204 and 305,205, while concurrently essentially eliminating the quantity of the outer enclosure material required to make up the sides and the bottom of the outer enclosure container.

In another labelling arrangement of the present invention, instead of using labelling of a separate material, all of the label information can be printed on the flexible film itself. While this arrangement will not provide protection for the flexible film in the same manner as the above described separate label or labels, this labelling arrangement nonetheless has the advantage of completely eliminating essentially all packaging materials other than the rigid base tray itself and its flexible film covering. Printed graphics on the film can of course duplicate any of the above described separate labels including covering smaller printed areas, permitting the product to be viewed around the exterior of the printed areas, or duplicating the appearance of a full faced label extending over the entire top of the tray with clear areas for viewing the product through the transparent film.

In still another labelling arrangement, a shrink wrapped band may be wrapped around the base tray and its flexible film. This embodiment would simplify printing of labelling material on the top and/or bottom of the package since all printing could occur on the shrink wrap material itself.

In any of the above described arrangements, further structures can be applied to the bottom of the tray to protect the structural integrity of the tray and/or provide a means to enable the package to stand on edge. In accordance with a first embodiment, a relatively stiff back panel may be attached to the bottoms of the compartments of the tray with the panel extending outwardly from the compartments in at least one direction so that its edge is parallel with the outer periphery of one of the sides of the peripheral flanges and located immediately beneath it. The package would then stand up on the edge of the back panel and the parallel peripheral edge along the top of the tray. Such a back panel would serve the dual functions of protecting the bottoms of the compartments against indentations and providing the means for permitting the package to stand on edge.

The back panel may take many different forms. For example, if it is not necessary that the back panel serve the function of protecting the bottoms of all compartments, it may cover only a portion of the bottom of the tray. Thus, viewing the back of the package when standing on edge, the back panel may cover only the lower half of the back or, in the case of the rectangular tray, with the long sides of the tray extending horizontally in said upright position, the back panel need not cover the full length of the tray.

In accordance with further variations of the back panel, the lower edge of the back panel may be folded so as to extend along that edge of the tray on which the package is standing. As an alternative to arranging the back panel below the bottoms of some or all of the compartments of the tray, the tray itself may be thermoformed with recessed shoulder areas in the bottoms of the compartments, i.e., recessed to a depth equal to the thickness of the back panel, so that with the back panel in place in the recessed areas, the back panel is flush with rather than below the lowermost surface of the tray.

Other arrangements for causing the tray to stand on end may include a plastic grid insert which is relatively stiff and can be placed in shallow recessed shoulders formed in the bottoms of the compartments so that the grid insert lies flush with the remainder of the bottoms of the compartments, said grid insert including an extension which extends outwardly to a line parallel to and located directly beneath the outer periphery of one of the peripheral flanges.

In another arrangement, the rigid base tray itself can be formed with a keel structure or the like, namely projections formed in the side walls of the base tray itself and extending outwardly to a line parallel with and directly beneath the outer periphery of one of the peripheral flanges on the top of the tray. These keels, separately from or in addition to a back panel will form a line which together with its corresponding outer periphery along the top of the tray will provide the tray with the capability to stand on that edge.

As noted above, the back panel may serve two functions, i.e., providing a space for label information and, in some embodiments, providing the ability for the package to stand on edge. However, in those embodiments wherein the capability of the package to stand on edge is caused by means other than the back panel, for example the grid insert or the keels, a thin pressure sensitive label may be placed over the bottoms of the compartments instead of the back panel to provide a space for the printing of label information. This label may extend on only part of the bottom, and/or it can wrap around and cover part of at least one side.

In still another embodiment of the present invention, the means for displaying the package in an upright position may comprise a header, i.e., an extension of the upper surface of the base tray in the upward direction, together with a peg hole therein.

In the absence of a protective back panel, and depending on the particular material used to form the rigid base tray, it may be desirable to protect the bottoms of the compartments against damage by thermoforming the lower corners of the respective compartments either flat or indented.

Another feature of the present invention is the utilization of materials which are readily recyclable, including the use of compatible materials where possible in the different parts of the package so as to facilitate the recycling thereof.

Thus, it is an object of the present invention to provide, in combination with a food package comprising a rigid base tray and a flexible film hermetically sealing the compartments thereof, new and improved arrangements for providing label information.

It is another object of the present invention to provide a package comprising a rigid base tray of the type described wherein the quantity of material utilized for preserving the structural integrity of the package, for displaying the package in an upright condition and/or conveying label information is substantially reduced relative to the known outer enclosure container.

It is still another object of the present invention to provide, in a package of the type described, various alternative means for permitting the package to stand on edge or otherwise be displayed in an upright condition.

It is still another object of the present invention to provide, in a rigid base tray package of the type described, means for protecting the bottoms of the compartments of the tray against damage.

It is still another object of the present invention to provide a "green" environmental friendly package which uses a lesser quantity of packaging materials than used heretofore and where possible utilizes recyclable materials which are compatible with each other to facilitate the recycling thereof.

Other objects and advantages of the invention will be apparent from the detailed description to follow which is to be read together with the accompanying drawings.

BRIEF DESCRIPTION OF THE DRAWINGS

The present invention will now be described in detail with respect to preferred embodiments thereof, which are to be taken together with the accompanying drawings, wherein:

FIG. 30 is a partial bottom perspective view of the rigid base tray of any of FIGS. 1 to 9 or 26 to 29, showing a modification thereof.

FIG. 31 is a partial bottom perspective view of the rigid base tray of any of FIGS. 1 to 9 or 26 to 29, showing still another modification thereof.

FIG. 32 is a perspective view of a rigid base tray, showing another modification of a labelling arrangement of the present invention.

FIG. 33 is a front perspective view of a different size and shape of rigid base tray from that shown in FIGS. 1 through 9.

FIG. 34 is a left side elevational view of FIG. 33.

FIG. 35 is an exploded schematic view provided to illustrate the materials utilized in the present invention.

DETAILED DESCRIPTION OF THE PREFERRED EMBODIMENTS

Figure 1:
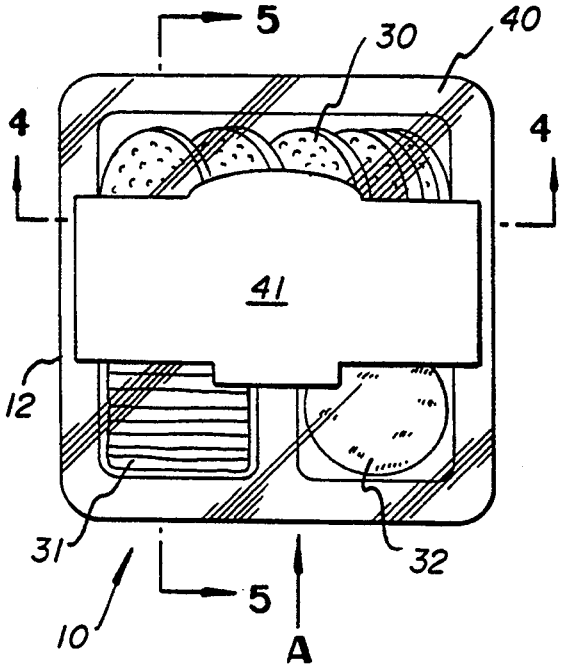
FIG. 1 is a top view of a package made in accordance with the present invention.

Referring now to the drawings, like elements are represented by like numerals throughout the several views.

Figure 1A:
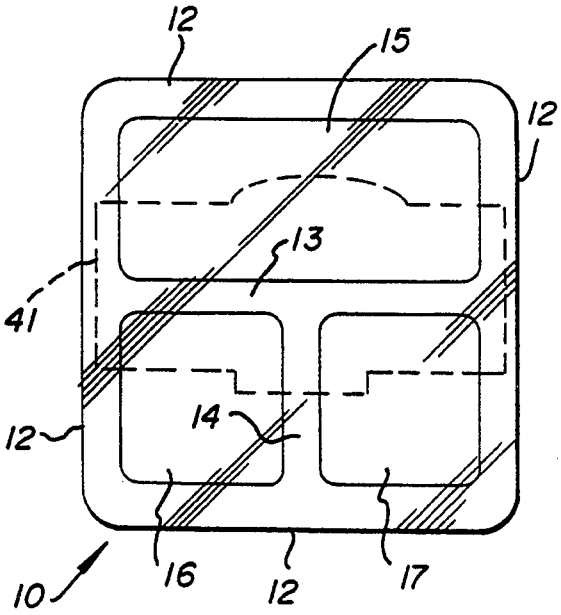
FIG. 1A is a top view of the package of FIG. 1, but with the label removed and shown in dotted lines and with the food products omitted.
Figure 2:
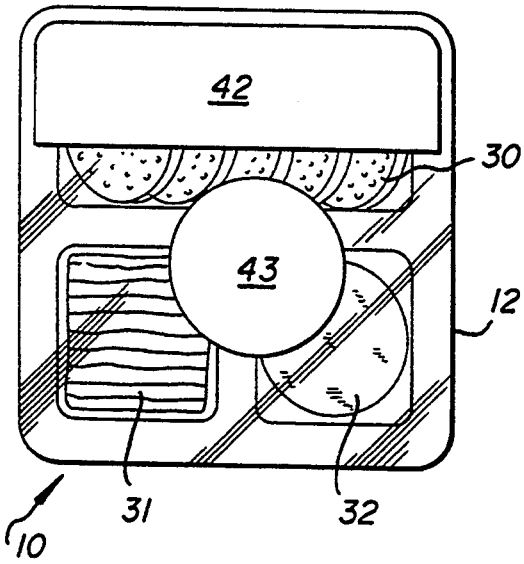
FIG. 2 is a top view of a package made in accordance with another embodiment of the present invention.
Figure 2A:
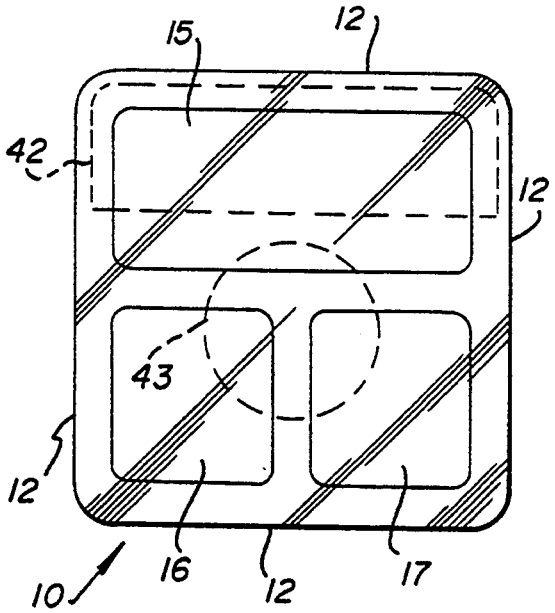
FIG. 2A is a top view of the package of FIG. 2, but with the labels removed and shown in dotted lines and with the food products omitted.

FIGS. 1 through 5 illustrate a package 10 made in accordance with a first embodiment of the present invention, wherein FIGS. 1, 1A and 3 through 5 illustrate one arrangement of labels on top of the package while FIGS. 2 and 2A illustrate another arrangement of such labels.

The food package 10 of the present invention comprises a rigid base tray having in its uppermost reference plane peripheral flanges 12 completely surrounding the outer periphery, a longer internal flange 13 and a shorter internal flange 14. These internal flanges divide the base tray into a larger recessed compartment 15 which takes up approximately half of the area of the rigid base tray while the smaller internal flange 14 divides the side of the food package opposite from compartment 15 into two smaller generally square and equally sized compartments 16 and 17.

Figure 3:
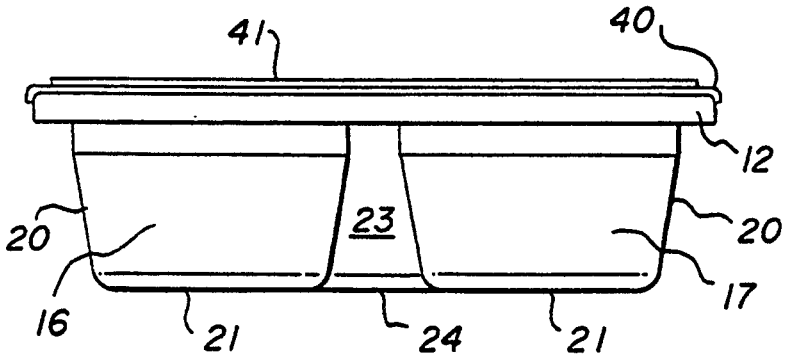
FIG. 3 is a side elevational view taken in the direction of the arrow A of FIG. 1.
Figure 4:
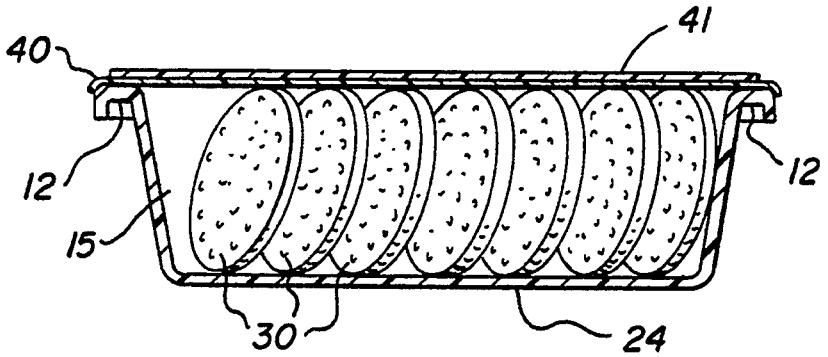
FIG. 4 is a cross-sectional view taken along line 4—4 of FIG. 1.
Figure 5:
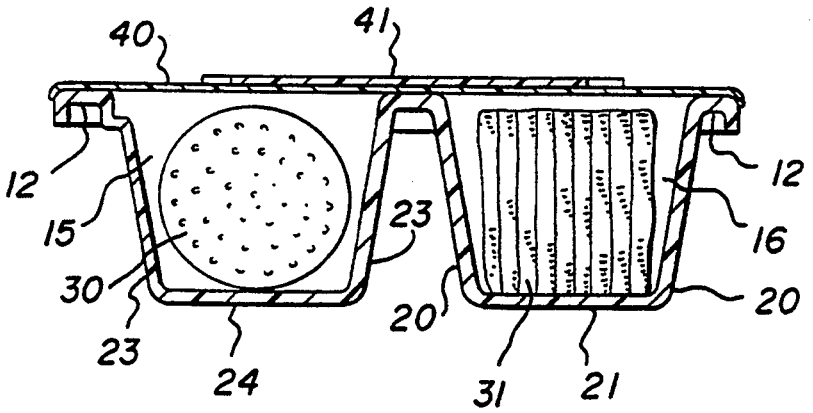
FIG. 5 is a cross-sectional view taken along line 5—5 of FIG. 1.

The compartments 15, 16 and 17 are recessed to a depth of at least 0.35 inches and preferably between approximately ¾" and 2". In FIGS. 3 through 5, the side walls of compartment 15 are designated as 23, extending down to a bottom 24 while the side walls of compartments 16 and 17 are designated as 20, extending down to bottoms 21.

The food package 10 is covered by a transparent flexible film 40 which is airtightly sealed to the peripheral and internal flanges 12, 13 and 14 to hermetically seal the respective compartments from the atmosphere and preferably from each other. In FIGS. 3 through 5 as well as in all other figures in which materials are shown on edge or in cross section, it will be understood that the thicknesses of these materials are enlarged for purposes of illustration.

In practice, the package can include virtually any food product. Examples include proteinaceous foods such as meat, fish, poultry, cheese, peanut butter, etc, farinaceous foods such as bread, crackers, etc., condiments, desserts, including confectioneries, fruits, and so on. The compartments may also include implements such as plastic utensils and napkins. One typical package of the present type may include in the larger compartment 15 a plurality of crackers or the like 30 while the smaller compartments 16 and 17 could generally include cheeses, meats, fish or the like, a cheese product 31 being shown in compartment 16 and a meat or fish product 32 being shown in compartment 17. Other packages may be of different shapes. Another preferred package can have the shape as shown in FIGS. 33 and 34, as explained below.

In accordance with the present invention, to help preserve the structural integrity of the package and to convey label information, labels are strategically positioned across the top of the package. Referring to FIG. 1, the label 41 is positioned so as to permit viewing of the contents of each of the compartments 15, 16 and 17, and more specifically, the crackers or the like 30, the cheeses or the like 31 and the meats, fishes or the like 32.

In accordance with another feature of the present invention, the label 41 is so positioned on the package that it is partially supported from below by peripheral and/or internal flanges, thereby facilitating application thereof to the package without the need to apply an excess force against unsupported portions of the film, thereby preventing damaging the flexible film. FIG. 1A illustrates in dotted lines the position of the label 41 on the tray 10 (with the food products removed for simplicity) with the flanges shown thereon in solid lines which would be beneath the label 41.

FIGS. 2 and 2A illustrate another embodiment of the present invention. FIG. 2 illustrates an arrangement using a pair of labels 42 and 43. Label 42 covers one side of the package, exposing a portion of the crackers 30 within large compartment 15 and being supported on three sides by peripheral flanges 12. In this arrangement, a second label 43 may be provided to convey additional information, this label being supported by portions of internal flanges 13 and 14. FIG. 2A illustrates the embodiment of FIG. 2 with the food contents removed for simplicity and with the outlines of labels 42 and 43 shown in dotted lines.

Preferably, labels 41, 42 and 43 would be opaque. However, it is to be understood that so long as labels 41 through 43 are of a sufficient thickness for the printing of label information thereon, these labels can be of a transparent material.

The label or labels preferably covers at least 30% but preferably approximately at least 50% of the top surface of the tray which is generally sufficient for conveying label information while concurrently permitting sufficient partial visibility of the food contents of the tray. Also, this degree of coverage of the top provides a degree of protection of the flexible film during normal handling of the package during ordinary travel thereof in commerce from the manufacturer thereof to the supermarket shelf.

In the discussion which follows relating to further embodiments and modifications, with reference to FIGS. 6 through 35, the food products will be omitted from the drawings for purposes of clarity. However, it will be understood that in all of the subsequently discussed and illustrated variations and embodiments, the rigid tray would, in the finished package include the appropriate food products.

Figure 6:
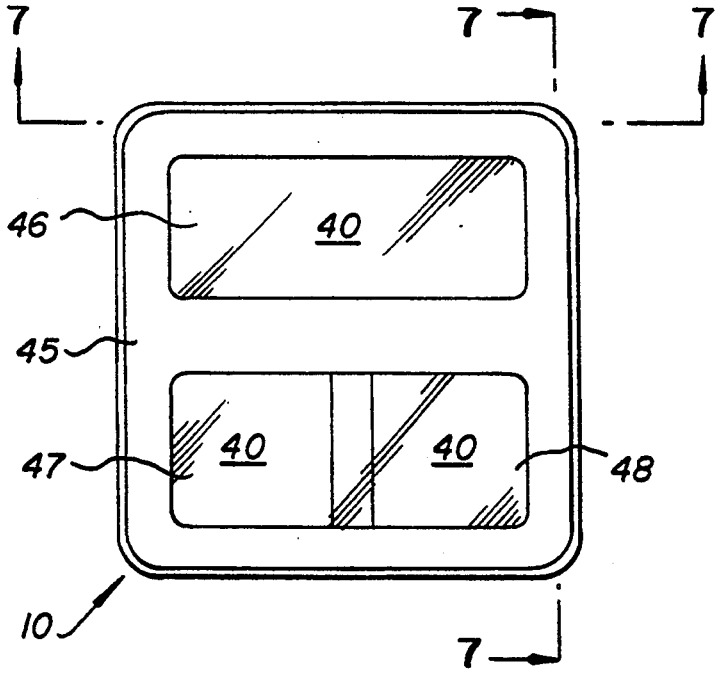
FIG. 6 is a top plan view of a package made in accordance with another embodiment of the present invention.
Figure 7:
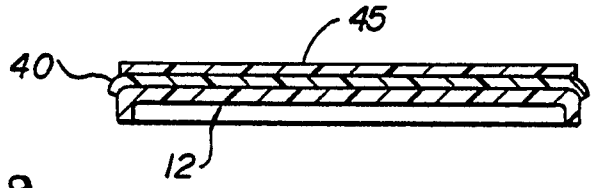
FIG. 7 is a cross-sectional view taken along either of the lines 7—7 of FIG. 6.

FIGS. 6 and 7 illustrate an arrangement which is similar to the embodiments of FIGS. 1 through 5 in that a label is applied to the top of the transparent flexible film 40. However, in this case the label 45 is a "full faced" label in that its outer periphery matches the outer periphery of the rigid base tray with cutouts 46, 47 and 48 to permit viewing of the product through the flexible film 40. With this embodiment, the label visually simulates the top of the previously used outer enclosure container, but of course without any packaging materials other than the full faced label itself. In all other respects, the embodiment of FIGS. 6 and 7 is similar to the embodiments of FIGS. 1 through 5.

Figure 8:
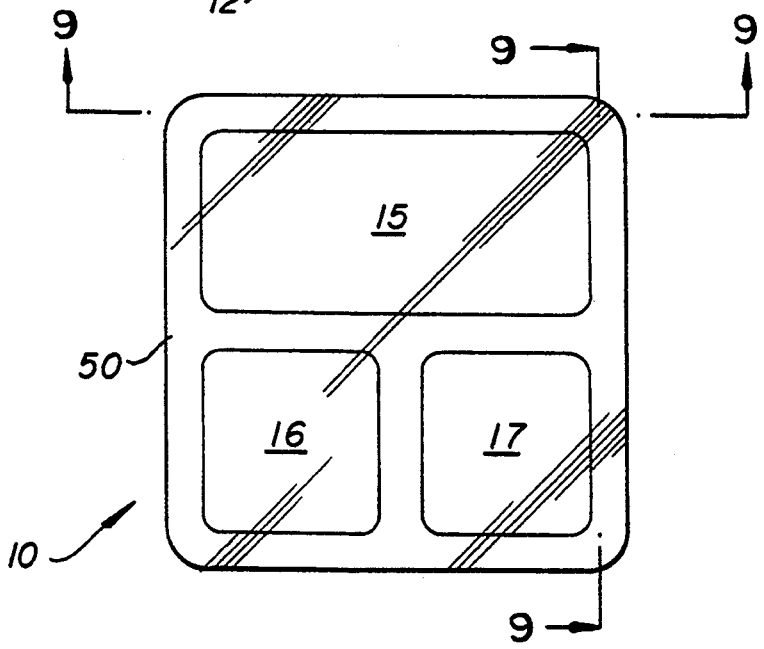
FIG. 8 is a top plan view showing still another embodiment of the present invention.
Figure 9:
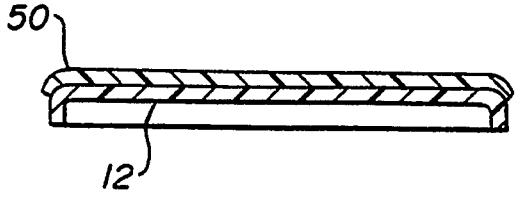
FIG. 9 is a cross-sectional view taken along either of the lines 9—9 of FIG. 8.

FIGS. 8 and 9 illustrate still another embodiment wherein all of the graphics is printed on the flexible film 50 itself. Although this embodiment lacks any materials covering over and hence providing some protection for the flexible film, this embodiment has the significant advantage of essentially eliminating all packaging materials other than the rigid base tray and the flexible film itself.

An advantage of all of the embodiments shown in FIGS. 1 through 9 is that the reduction in packaging material resulting from eliminating the outer enclosure container is achieved without any decrease in the visual impact of the package on the consumer while on the supermarket shelf.

In the commercialization of a food product in a rigid base tray of the type described, it is important that the tray be capable of being displayed in an upright condition with the "top", i.e., the surface through which the food products are visible, actually being located in a vertical plane facing the potential customer. Preferably, this is accomplished by constructing the package so that it can stand on the edge adjacent the "top" which would engage the supporting surface when the printing on the "top" is upright in said vertical plane. In the alternative, the package can be arranged in this upright condition by a structure which permits hanging of the package from above. The preferred arrangement, however, is to construct the package so that it can stand up on the said edge. In the previous package, which included an outer enclosure, one side of that outer enclosure constituted the means for standing the package on edge. Thus, in the present invention which eliminates the outer enclosure container, some other means must be provided for displaying the package in said upright condition, either on edge or hanging from above.

In accordance with the present invention, as discussed below, numerous arrangements are provided for causing the package to stand on edge. Certain of these arrangements inherently provide additional space for the printing of label information while other of these arrangements do not. In the case of the latter, additional means such as a pressure sensitive label or the like can be applied to the bottom of the package in ways to be discussed below to provide space for additional label information. In addition, the means provided and discussed below for causing the package to stand on end can provide the additional functions of protecting the compartments of the tray against damage dents or the like and otherwise strengthening the rigidity of the package. This additional strengthening of the package may have the added advantage of permitting the use of a thinner and hence a more economical material to form the rigid base tray itself.

Figure 10:
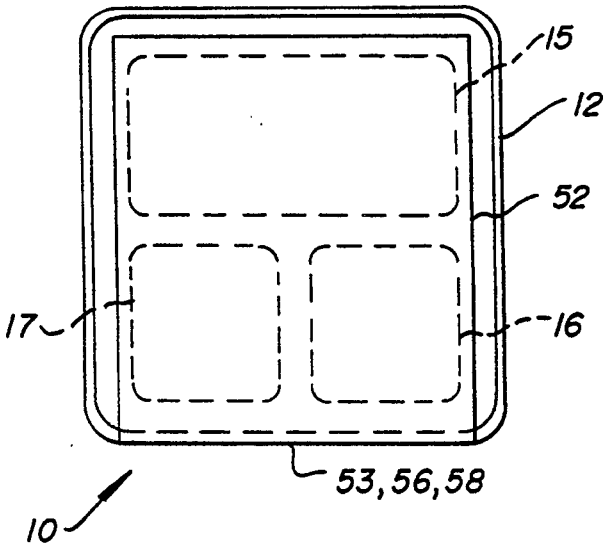
FIG. 10 is a bottom plan view of any one of the packages of FIGS. 1 through 9, showing a modification thereof.

Referring to FIG. 10, the back panel comprises a relatively stiff panel 52 which preferably overlies the bottoms of all of the compartments and is adhered thereto by a suitable means such as hot melt adhesive. The lower edge of this back panel 52 is located on a line directly behind the outermost edge of the lowermost peripheral flange 12. In this manner, the lower edge of the panel along with the outer edge of the lowermost peripheral flange 12 together provide a pair of parallel edges on which the package can stand with relative stability.

Figure 11:
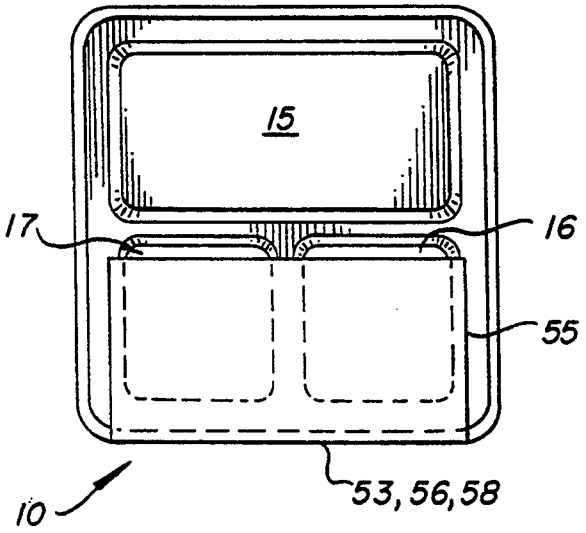
FIG. 11 is a bottom plan view of any of the packages of FIGS. 1 through 9, showing another modification thereof.

FIG. 11 differs from FIG. 10 in that the back panel 55 covers only the lowermost portion of the bottom of the rigid tray 10.

Figure 12:
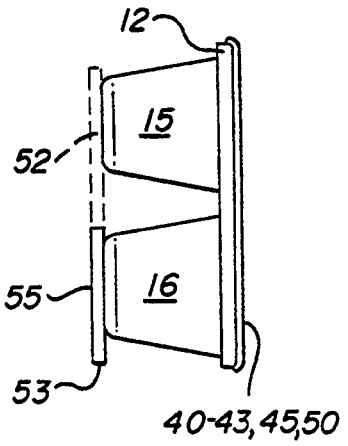
FIGS. 12, 13 and 14 are all side elevational views of either FIG. 10 or FIG. 11, showing three different arrangements for the bottom of either of the back panels of FIGS. 10 or 11.
Figure 13:
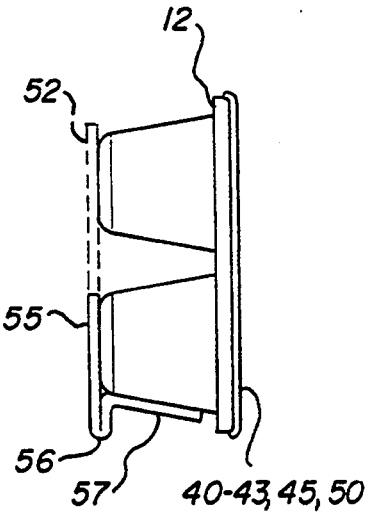
Figure 14:
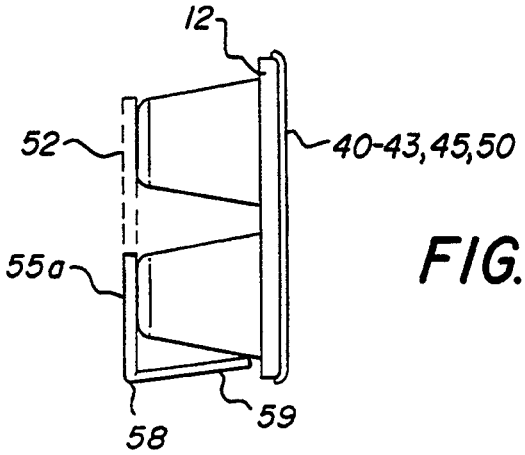

Referring to FIGS. 12, 13 and 14, either back panel 52 or 55 can terminate in a straight edge 53, as shown in FIG. 12, being bent upwardly and along the side of the package as shown at 56 and 57 in FIG. 13 or bent inwardly as shown at 58 and 59 in FIG. 14. The surfaces 57 and 59 in FIGS. 13 and 14 have the advantage of providing an added surface area for further label information.

Figure 15:
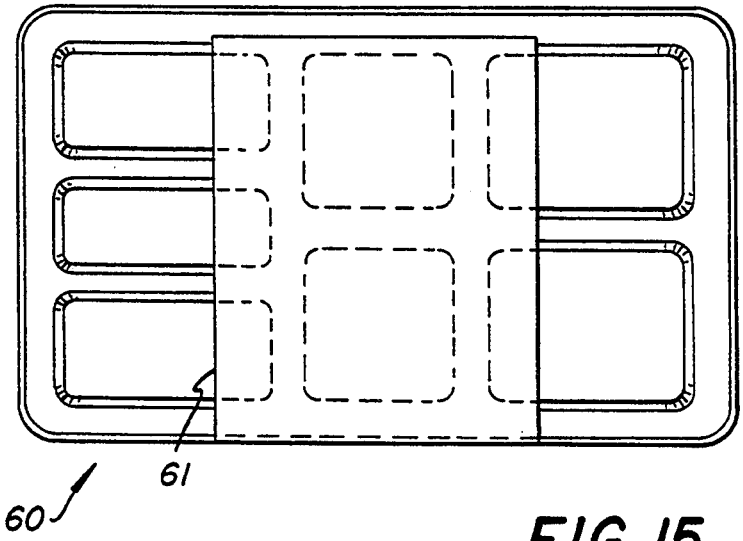
FIG. 15 is a bottom plan view similar to FIG. 10 but illustrating the back panel on a larger rigid base tray.

FIG. 15 illustrates the principle of a back panel as applied to a rigid base tray having a shape different from that shown in FIGS. 1 through 14. As discussed above, the rigid base tray can have virtually any shape. One additional preferred shape is the rigid tray 60 shown in FIGS. 15, 33 and 34. This rigid base tray is essentially the same width as one side of the generally square embodiment shown in FIGS. 1 through 14 but is elongated in the other direction, providing a larger, rectangular package. In this preferred arrangement, seven different compartments are shown including left hand compartments 92, 93 and 94 and four other compartments. This larger package may include any of the food or other products, as discussed above.

It is to be understood that in all of the embodiments and variations shown in FIGS. 10 through 31, 33 and 34, the structure provided on the top of the package for providing labelling information and openings for viewing of the product can be any of the arrangements shown in FIGS. 1 through 9. To indicate this, in FIGS. 10 through 25, 30, 31, 33 and 34, the top is referred to by the reference numerals 40–43 or 45 thereby representing either a transparent flexible film with some type of label structure 41, 42, 43 or 45 adhered thereto or the flexible film 50 with graphics printed thereon. Additionally, the numerals 78 and 81 in FIGS. 26 through 29, while representing a different shape, nonetheless represent any of the label or graphics arrangements as shown in FIGS. 1 through 9.

It is also to be understood that the back panels shown in FIGS. 10 through 14 need not extend for a width so as to cover both of the lower compartments, but instead can be more narrow, covering only a portion of the upper or both lower compartments. Of course in this case the rigid back panel would not provide the same protection for the lower corners of the compartment. Additionally, the bottoms of the back panels 52, 55 or 61 below the compartment (that is, lower than the compartments as they appear in FIGS. 10, 11 and 15) need not extend for the full width of the card, but can instead extend for only a portion thereof, thereby providing a tab of sufficient length to support the package in an upright condition in combination with the lowermost peripheral flange 12.

Any of the back panels would be constructed of a relatively stiff material such as paperboard or a relatively thick plastic material such as high density polyethylene. The appropriate materials for the back panel as well as the other components of the package will be discussed in greater detail below.

Figure 16:
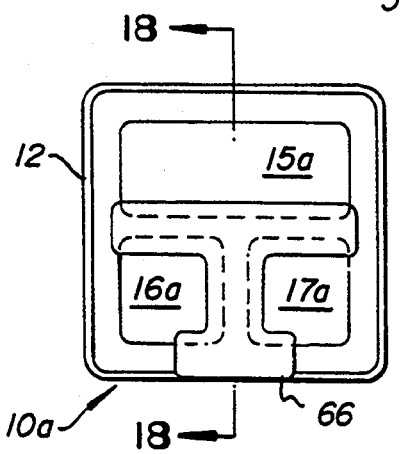
FIG. 16 is a bottom plan view of any of the packages of FIGS. 1 through 9, showing a further modification thereof.
Figure 17:
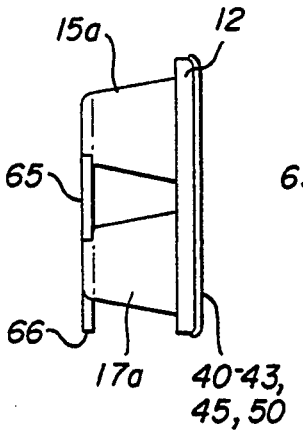
FIG. 17 is a right side elevational view of FIG. 16.
Figure 18:
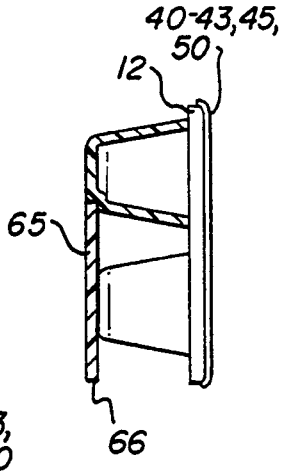
FIG. 18 is a cross-sectional view taken along line 18—18 of FIG. 16.

FIGS. 16 through 18 show still another arrangement for allowing the package to stand on end. Referring to these figures, this package **10*a* is identical to the package 10 except that portions of the lower compartments, designated here as 15*a*, 16*a* and 17*a* are originally thermoformed with recessed shoulder areas shaped to receive a generally flat hard grid insert 65 such that the outer surface of the grid insert 65 is essentially flush with the non-recessed surfaces of the bottoms of compartments 15*a*, 16*a* and 17*a*. At its lower end ("lower" as viewed in FIGS. 16 through 18) the grid insert includes a tab portion 66, the lower edge of which is parallel to the lowermost edge of lower peripheral flange 12, thereby forming a stand therewith. The tab portion 66** can of course be thinner than as shown and can extend for slightly less or a greater width of the package, provided that it is of sufficient length to provide stability when the package is stood up on that edge.

Figure 19:
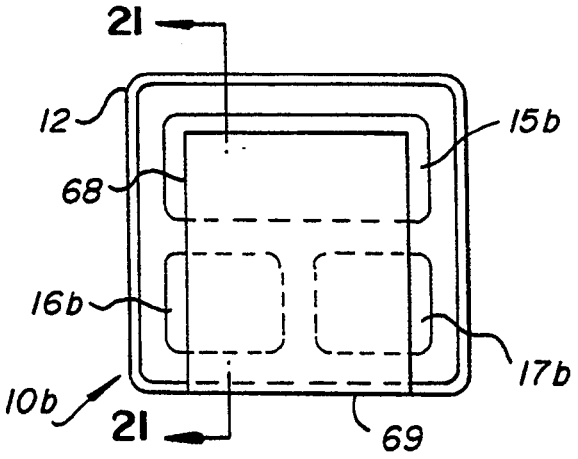
FIG. 19 is a bottom plan view of any of the packages of FIGS. 1 through 9, showing a further modification thereof.
Figure 20:
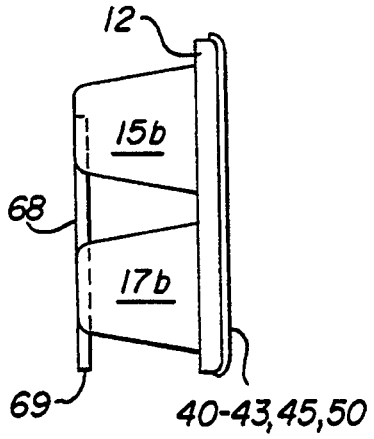
FIG. 20 is a right side elevational view of FIG. 19.
Figure 21:
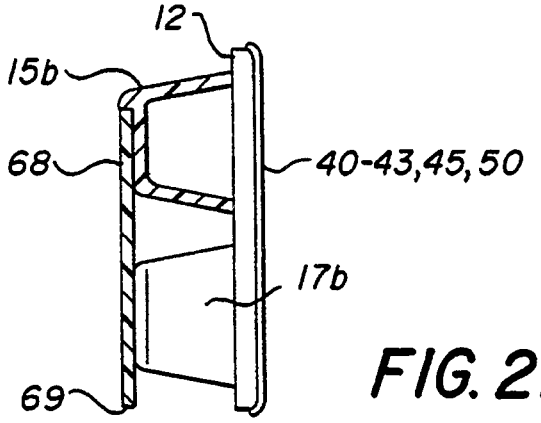
FIG. 21 is a cross-sectional view taken along line 21—21 of FIG. 19.

FIGS. 19 through 21 show another arrangement which is similar to the embodiment of FIG. 10 except that in this package **10*b* the compartments 15*b*, 16*b* and 17*b* are thermoformed essentially recessed to the depth of the back panel 58 in the areas which receive the back panel 68 so that this back panel together with the non-recessed portions of the bottoms of compartments 15*b*, 16*b* and 17*b* form a flush outer surface, as is clear from FIGS. 19 through 21**.

It is to be understood that the lower end 69 of the back panel 68, can include the variations shown in FIGS. 12, 13 and 14. Like FIG. 13, the back panel 68 can overlie portions of only the smaller compartment **16*b* and 17*b*. Of course in this case the compartment 15*b* would have no recessed portion at all and the uppermost portions of compartments 16*b* and 17*b* above the card (i.e., "above" as viewed in FIGS. 19 to 21) would also not be recessed, just as the uppermost part of compartment 15*b* is shown non-recessed in FIGS. 19–21. Additionally, the lower end 69 of this card 68, which along with the lower peripheral flange 12 forms the stand-up feature can be formed as shown in FIGS. 13 or 14. Additionally, the lowermost end 69 can be of a lesser width than the remainder of the back panel 68**, forming a tab portion, so long as it is of sufficient width to allow the package to have stability when standing on that edge.

Figure 22:
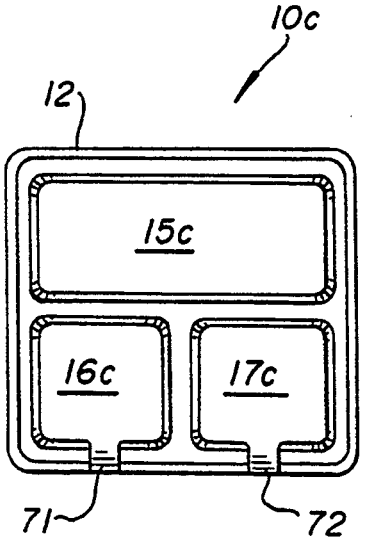
FIG. 22 is a bottom plan view of any of the packages of FIGS. 1 through 9, showing a further modification thereof.
Figure 23:
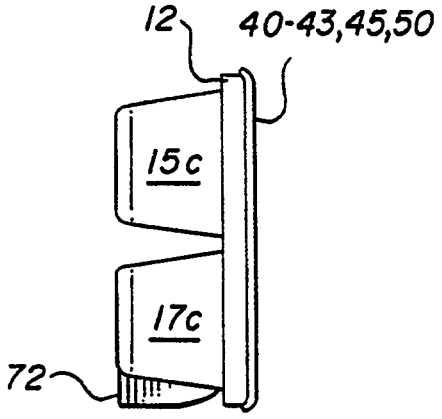
FIG. 23 is a right side elevational view of FIG. 22.

FIGS. 22 and 23 show still another modification for allowing this package to stand on end. In this arrangement, in the package **10*c*, the lower smaller compartments 16*c* and 17*c* are originally thermoformed with outward projections 71, 72**, which may be referred to as keels.

Figure 24:
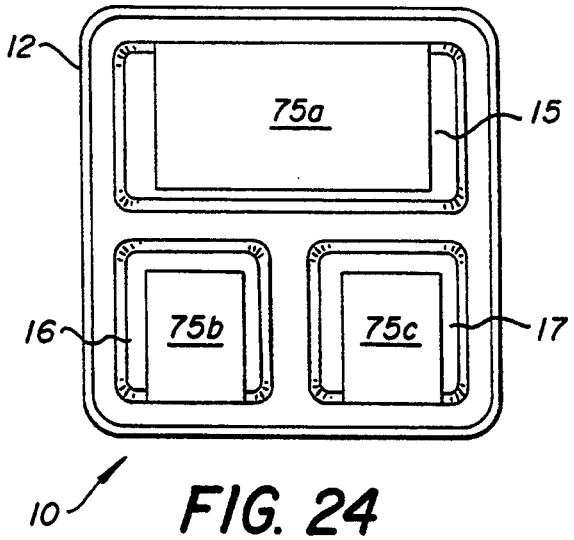
FIG. 24 is a bottom plan view of any of the packages of FIGS. 1 through 9, showing a further modification thereof.
Figure 25:
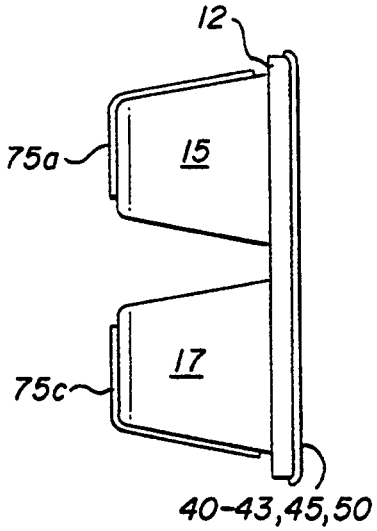
FIG. 25 is a right side elevational view of FIG. 24.

As discussed above, one purpose of the present invention is to provide a space on the bottom of the package to provide labelling information in addition to that provided on the top of the package. This can be accomplished in several ways. First, if a rigid back panel is used, i.e., of the type shown in FIGS. 10 through 15 and 19 through 21, the additional labelling information may of course be provided thereon. In the embodiment of FIGS. 16 through 18, since the bottoms of the compartments and the grid insert lie in a common plane, label information can be provided directly thereon. However, in the absence of a rigid back panel, i.e., in the embodiments of FIGS. 16 through 18 as well as FIGS. 22 and 23, wherein a stand-up feature is provided in the absence of a rigid back panel, it may be desirable to attach a conventional thin pressure sensitive label directly to the bottoms of the compartments. Such an arrangement is shown in FIGS. 24 and 25 which illustrates a package 10 with pressure sensitive label or labels 75*a*, 75*b* and/or 75*c* attached to the bottoms of the compartments. Although these labels can be arranged in any suitable way, it is preferable that they not bridge gaps between compartments. Additionally, as shown in FIG. 25, these labels can wrap around and extend up the sides of their respective compartments.

Figure 26:
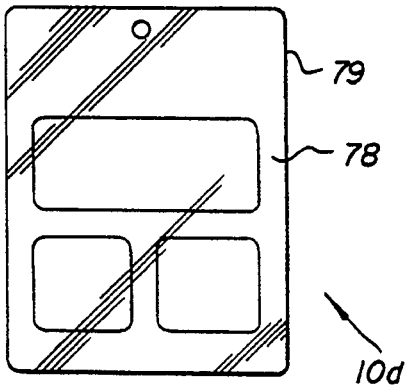
FIG. 26 is a top plan view of a rigid base tray showing another embodiment of the present invention.
Figure 27:
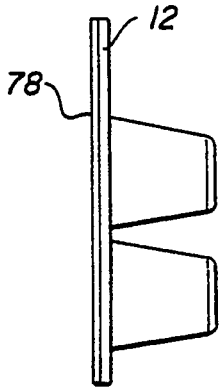
FIG. 27 is a right side elevational view of FIG. 26.

FIGS. 26 through 29 illustrate modifications of the present invention wherein the means for causing the package to be displayed in an upright condition include header structures with pegboard openings rather than structures for permitting the package to stand on edge. Referring to FIGS. 26 and 27, the package 10*d* includes an enlarged top 78 which extends upwardly to a header portion 79. In the embodiment of FIGS. 26 and 27, the flange portion of the rigid base tray 10 would include an upward extension while the materials which overlie the rigid base tray, including any of the structures shown in FIGS. 1 through 9, would also extend upwardly, covering this upward extension 79 of the upper peripheral flange 12.

Figure 28:
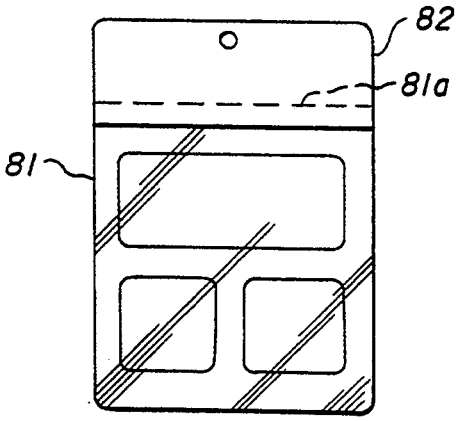
FIG. 28 is a top plan view of still another embodiment of the present invention.
Figure 29:
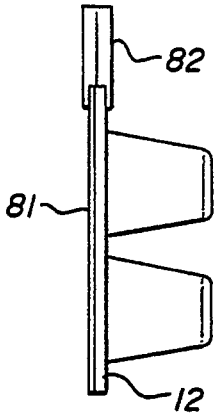
FIG. 29 is a right side elevational view of FIG. 28.

FIGS. 28 and 29 are similar to FIGS. 26 and 27 except that in this case the top 81 of the package 10*e* extends only up to a height 81*a*. The header portion is then formed by a label 82 of the same material as label 41 but slightly thicker and stronger, folded over to engage the upper portion of the peripheral flange 12 on each side of the lip portion 81*a*.

As discussed in greater detail below, the rigid base tray can be formed of various materials. If formed of a relatively stiff material such as polystyrene, the rigid base tray would tend to be relatively stiff and of such a nature that the compartments, and especially the lower corners thereof, could be damaged if dented or the like in handling. Using certain other materials such as high density polyethylene would provide a somewhat softer and more durable package such that the lower corners would not be as readily damaged. In the case of the stiffer materials such as polystyrene, and in the absence of a base panel, these corners may be formed with structures to guard against such deformations. FIG. 30 illustrates one arrangement wherein a portion of the package 10*f* illustrates the bottoms of two of the smaller compartments 16*f* and 17*f*, wherein the corners of each of the compartments have been thermoformed as flat surfaces 84. In FIG. 14 the package 10*g* has had the four corners of the respective compartments 16*g* and 17*g* thermoformed with rounded indentations 86.

FIG. 32 illustrates another embodiment wherein labelling information on the top and/or the bottom are provided on a shrink wrapped band 90 which is shrunk around the package 10 and its flexible film 40. The band would of course be wrapped around the package 10 in the "horizontal" direction so as to leave exposed the end adjacent the smaller compartments 16 and 17 so that any one of the described arrangements for causing this package to stand on edge can be utilized. As illustrated, this package includes a back panel 52 which extends to a lower edge 53 to provide a stand-up function as described with respect to FIGS. 10 and 12. Of course any of the other stand-up arrangements can be provided, as can any of the arrangements shown in FIGS. 26 through 29 to provide a header for hanging this package on a pegboard. The band may be printed on the top and/or the bottom. If printing is on the top, the flexible film would most likely be transparent. In the absence of printing on the top, the band would most likely be transparent so as to fully expose printing on the flexible film as shown in FIGS. 8 and 9. Similarly, if no printing is present on the bottom, the bottom would probably be transparent so as to expose printing on the bottom of the compartments or on back panels or labels attached thereto.

The selection of materials for the various components of the package of the present invention must satisfy many different criteria. First, the materials must of course satisfy the basic function of preserving the quality of the food products. In addition, the composition of at least some components must have sufficient strength so that the structural integrity of the package is preserved throughout its entire travel in commerce from the original manufacturer to the end consumer. In addition, selected surfaces of the package must be capable of receiving printed label information.

In addition, it is a particular goal of the present invention to select materials wherein recyclability is maximized.

Some materials naturally receive ink more readily than others. Moreover, thinner materials can be printed more economically since the printing can be done on roll stock, whereas if the material is relatively thick, the material will not roll up easily, meaning that the printing step will be done on sheets and therefore will be more costly. These factors suggest that the printing step be carried out where possible on thinner plastic materials rather than thicker plastic materials, or of course on paperboard stock. The labels 41–43 may be paper based and the back panels may be made of paperboard stock which is readily printable. Conversely, if the rigid stand-up back panel such as elements 52, 55 and 61 are made of plastic rather than paperboard, it might be more costly to print graphics thereon. On the other hand, as explained below, stiff plastic back panels may be preferable with respect to recycling goals.

As noted above, a goal of the present invention is to maximize recyclability. The laws of many states code plastic materials for purposes of recyclability as follows:

1. Polyester
2. High density polyethylene (HDPE)
3. Polyvinyl chloride (PVC)
4. Low density polyethylene (LDPE)
5. Polypropylene
6. Polystyrene
7. Residue category for other plastics such as acrylonitrile copolymers, any multilayer plastic, etc.

Recyclability is maximized to the extent that the same material is used throughout a given package; and current recycling facilities favor the recycling of HDPE and Polyester.

Referring to FIG. 35, the base tray 10 is shown in its component parts including the base portion 97 itself, and a protective multilayer laminate 96.

The laminate 96 is preferably a three layer laminate including inner and outer layers of LDPE which serve as a moisture barrier and sealant layers. The inner layer may also be ethylene vinyl acetate (EVA). Sandwiched between the two LDPE layers is the oxygen barrier, such as ethylene vinyl alcohol (EVOH) or polyvinylidene dichloride (PVDC). The laminate 96 may also include thin tie layers which are thin layers of adhesive provided to bond the three main layers together.

Given this structure of the laminate 96, it is preferred to form the base portion 97 of the tray 10 of high density polyethylene. In addition to having favorable characteristics to serve as a tray, the material thereof will then be compatible with two of the three layers of the laminate 96, thereby maximizing recyclability of the tray because of the compatibility of the materials and because of the selection of the material in the second plastics recycling code category. Apart from these preferences, however, it will be understood that the base tray could of course be formed of other materials such as any of the categories listed in the plastics recycling code.

The flexible film 40 is also preferably a multilayer film. The outer layer can be formed of many different materials but it is preferably formed of polyester since this material is relatively strong and can accept ink or labels quite well. Alternatively, the outer layer could be nylon or polyethylene, but these materials would be more difficult to print and not quite as strong. The middle layer, like the middle layer of laminate 96 would be an oxygen barrier such as EVOH or PVDC. The lower of the three layers of the film 40 would be a moisture barrier and heat sealable material, preferably low density polyethylene which in addition could have an antifogging ingredient to prevent fogging and the collection of droplets.

Any labels such as 41 through 43, 75 or 82 would preferably be of a pressure sensitive paperbase material. While this material is not compatible with plastic recycling efforts, this portion of the package could initially be separated from the rigid base tray in which case compatibility would not be essential. Moreover, such a material provides a preferable surface for printing labelling information.

If a label such as 75 (FIG. 24) is applied to the bottom of the package, rather than a stiff back panel, pressure sensitive paperbase material would be excellent for printing purposes. However, for recycling purposes, it would be preferable to use a low density polyethylene material, provided however that it would be sufficiently thin that it could be easily printed. On the other hand, since recycling efforts could include a washing step to wash away this label, recyclability concerns may be minimized. In the case of a stiff back panel sufficient to fulfill the stand-up function, the desired material would include either paperboard for its printing capabilities or HDPE. This material would be satisfactory if it were not too thick, thereby permitting printing thereon, and it would of course have the advantage of being compatible with the material of the tray to maximize recyclability. These goals might be met with HDPE if the material would provide sufficient rigidity at a thickness of only about 7 to 8 mils. In any event, any of the materials listed above under plastics recyclability codes 1 through 7 could be used. Of course if the material were not compatible for recycling purposes, the back panel would preferably be attached to the base tray by suitable means such as a hot melt adhesive which could easily be removed by hand or broken down to remove the back panel during a pre-recycling washing step.

The grid insert of FIGS. 16 through 18 would preferably be formed of injection molded HDPE although any of the other materials listed above in the plastics recyclability codes could be utilized.

In the construction of the base portion 97 of the tray 10, HDPE would provide a material somewhat softer than other materials such as polystyrene. In this case, further rigidity could be imparted to the tray by thermoforming it with corrugations, ribs or the like. Because of this softer nature, the lower corners of a HDPE tray would not be as susceptible to damage and hence the protective measures shown in FIGS. 30 and 31 would not be necessary.

The shrink wrapped material of FIG. 32 would preferably be PVC. While this material is not compatible with the tray for recycling purposes, this is less important since the shrink wrapped band would initially be separated from the tray and discarded separately with the lidding.

Since many embodiments of the present invention leave the side surfaces of the rigid base tray exposed, it may be desirable to cover some of these surfaces with labels. For this purpose pressure sensitive paperbase materials similar to the label 41 through 43 would be used.

An important feature of the present invention is the easy peelability of the film 40 from the base tray 10. This is accomplished by forming the two engaging layers of the film 40 and the laminate 96 of dissimilar materials. As discussed above, both of these layers are preferably formed of LDPE. However, one layer would be pure while the other would include fillers.

Although the invention has been described in considerable detail, it will be apparent that the invention is capable of numerous modifications and variations, apparent to those skilled in the art, without departing from the spirit and scope of the invention.

We claim:

1. A food package comprising:

(a) a generally rectangular rigid plastic base tray having four side edges, a top and a bottom, at least three compartments, each compartment having side walls, said base tray having peripheral and internal flanges, said flanges being located in a reference plane, the peripheral flanges defining the four side edges of the tray, said compartments defined by side walls extending downwardly from said flanges, the flanges being of sufficient width for air-tightly sealing a flexible film thereto, and at least one of said compartments containing a food product, (b) an air impermeable flexible film in said reference plane affixed to the flanges and forming an air-tight seal at least with respect to said compartments containing the food product, the top of the film having associated therewith a package top design which is partially opaque, permitting viewing of the contents in at least one of said compartments, the top design being oriented such that it is upright when one of the said side edges is lowermost, and (c) a back panel comprising a flat relatively stiff sheet which is adhered to the bottom of the tray, one edge of said flat sheet extending beyond the bottom of the tray so as to be located in a plane which passes through said lowermost one of said side edges and is generally perpendicular to the reference plane, such that said lowermost side edge and said one panel edge form a pair of parallel edges on which the package can stand upright with the top design being oriented upright.

2. A food package according to claim 1, wherein the base tray is of a material selected from the group consisting of high density polyethylene, low density polyethylene, polystyrene, polyester, polypropylene, acrylonitrile copolymers or polyvinyl chloride.

3. A food package according to claim 2, wherein the base tray is made essentially of polystyrene.

4. A food package according to claim 3, wherein the base tray includes a multilayer laminated surface, a portion of which is low density polyethylene.

5. A food package according to claim 4, wherein the multilayer laminated surface comprises an outer layer of low density polyethylene, a middle layer which is an oxygen barrier and an inner layer of either low density polyethylene or ethylene vinyl acetate.

6. A food package according to claim 5, wherein the oxygen barrier is ethylene vinyl alcohol or polyvinylidene dichloride.

7. A food package according to claim 1, wherein the flexible film is a multilayer film, wherein the outermost layer comprises a material selected from the group consisting of polyester, nylon and polyethylene.

8. A food package according to claim 7, wherein the multilayer film further comprises an inner layer of low density polyethylene and an oxygen barrier middle layer.

9. A food package according to claim 8, wherein the middle layer is ethylene vinyl alcohol or polyvinylidene dichloride.

10. A food package according to claim 8, wherein the base tray includes a multilayer laminated surface, the outer surface of which is low density polyethylene, and wherein the engaging low density polyethylene layers of the laminated surface and of the flexible film are dissimilar so as to provide an easily peelable airtight engagement therebetween.

11. A food package according to claim 1 wherein the flexible film is a multilayer film, which is heat sealed, glued or ultrasonically sealed to the rigid plastic base tray.

12. A food package according to claim 1, wherein the package top design comprises printing of opaque areas on the flexible film itself, leaving transparent areas therein for viewing the product therethrough.

13. A food package according to claim 12, wherein the back panel covers the bottoms of only some of said compartments.

14. A food package according to claim 12, wherein the back panel covers the bottoms of all of said compartments.

15. A food package according to claim 12, wherein the bottom of the base tray is formed with recessed shoulders where the back panel contacts it, such that the back panel and the non-recessed portions of the bottom of the base tray are essentially coplanar.

16. A food package according to claim 12, wherein the back panel is bent from said one panel edge to extend along that corresponding side of the rigid base tray.

17. A food package according to claim 1, wherein at least some of the bottom corners of the compartments of the rigid base tray are originally thermoformed as flat corners so as to provide the rigid base tray with rigidity and to resist deformation of the respective compartments.

18. A food package according to claim 1, wherein at least some of the bottom corners of the compartments of the rigid base tray are originally thermoformed as indented corners so as to provide the rigid base tray with rigidity and to resist deformation of the respective compartments.

19. A food package according to claim 1, wherein on one side the peripheral flange extends outwardly to form a header portion.

20. A food package according to claim 1, wherein the packaged top design is provided on a shrink wrap band which is shrink wrapped about the package.

21. A food package according to claim 20, wherein the back panel covers the bottoms of only some of said compartments.

22. A food package according to claim 20, wherein the back panel covers the bottoms of all of said compartments.

23. The food package according to claim 1, wherein the package top design comprises at least one substantially flat label attached to the transparent flexible film.

24. A food package according to claim 23, wherein the back panel covers the bottoms of only some of said compartments.

25. A food package according to claim 23, wherein the back panel covers the bottoms of all of said compartments.

26. A food package according to claim 23, wherein the bottom of the base tray is formed with recessed shoulders where the back panel contacts it, such that the back panel and the non-recessed portions of the bottom of the base tray are essentially coplanar.

27. A food package according to claim 1, wherein the base tray comprises a base layer of a high density polyethylene and a thin oxygen impermeable laminate, said base layer and said laminate being of materials capable of being recycled together in the category of polyethylene.

28. A food package according to claim 27, wherein the laminate is made of ethylene vinyl alcohol and polyethylene, and the base layer is made of high density polyethylene, such that both the laminate and the base layer are capable of being recycled together as polyethylene.

29. A food package according to claim 1, wherein a larger compartment takes up approximately half of the area of the reference plane, with its side walls extending downwardly therefrom, and two smaller compartments each take up approximately one fourth the area of the reference plane, with their side walls extending downwardly therefrom, the said one panel edge which extends out from the bottom extending alongside the side edge of the package running along the two smaller compartments.

30. A food package according to claim 29, including a farinaceous food in the larger compartment and proteinaceous foods in each of the smaller compartments.

* * * * *